United States Patent [19]

Weintraub

[11] Patent Number: 4,759,122

[45] Date of Patent: Jul. 26, 1988

[54] DEVICE FOR MOUNTING ELECTRONIC CONNECTORS

[75] Inventor: Herbert M. Weintraub, Tarrytown, N.Y.

[73] Assignees: Leslie Weintraub, W. Nyack; Barry A. Weintraub, New City, both of N.Y.

[21] Appl. No.: 749,670

[22] Filed: Jun. 28, 1985

[51] Int. Cl.[4] ..... B25B 23/00

[52] U.S. Cl. ..... 29/750; 29/758; 81/439; 81/461

[58] Field of Search ..... 29/747, 739, 750–752, 29/758, 764; 81/176.15, 177.5, 437–439, 461

[56] References Cited

U.S. PATENT DOCUMENTS

| | | | |
|---|---|---|---|
| 1,318,088 | 10/1919 | Klein | 81/437 |
| 2,489,645 | 11/1949 | Jensen et al. | 81/437 |
| 3,034,550 | 5/1962 | Dahl | 81/437 |
| 3,354,756 | 11/1967 | Rusk | 81/176.15 |
| 3,760,659 | 9/1973 | Campbell | 81/176.15 |
| 4,050,149 | 9/1977 | Storck et al. | 29/758 |
| 4,242,932 | 1/1981 | Barmore | 81/438 |
| 4,408,391 | 10/1983 | Pohl | 29/751 |
| 4,416,059 | 11/1983 | Humphrey et al. | 29/758 |

*Primary Examiner*—P. W. Echols

*Attorney, Agent, or Firm*—Lilling & Greenspan

[57] ABSTRACT

Device or tool for mounting BNC connectors on the wall of a chassis or housing includes a handle on a shaft for rotating a driver element which is configured to mate with and engage a BNC connector to be mounted. By using different driver elements, male BNC connectors or other similar electronic (R.F.) connectors can be mounted on a housing or chassis without damaging internal components.

9 Claims, 3 Drawing Sheets

FIG.5
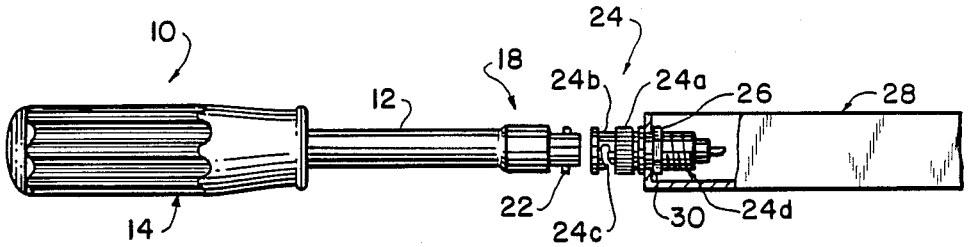
FIG.6
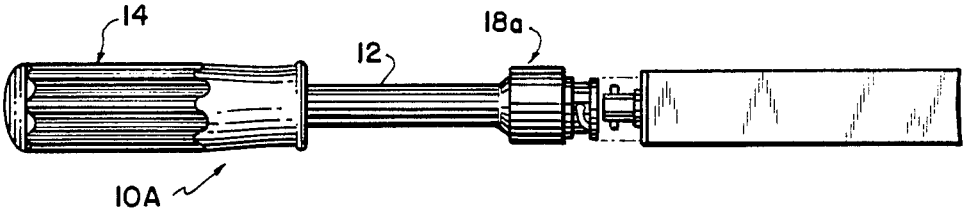
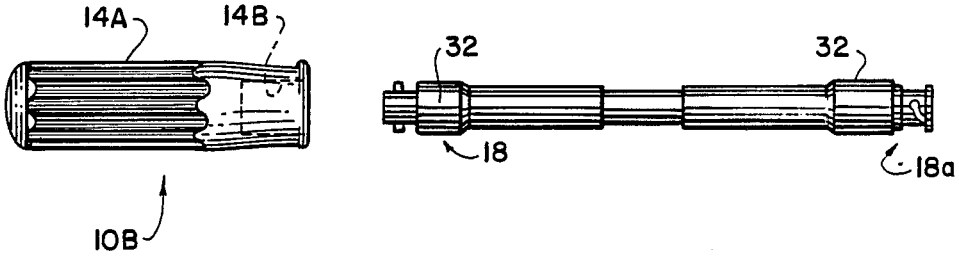
FIG.7

FIG. 8
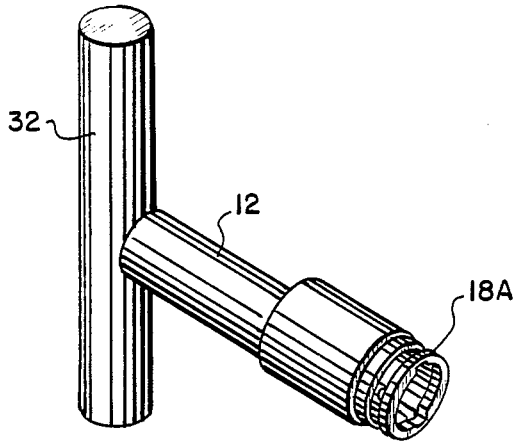
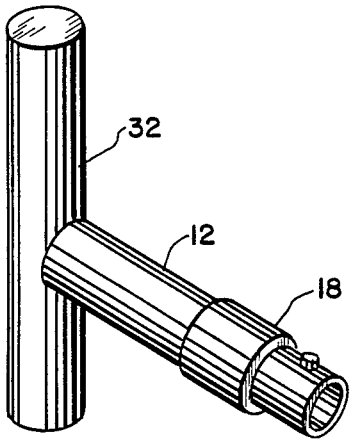
FIG. 9
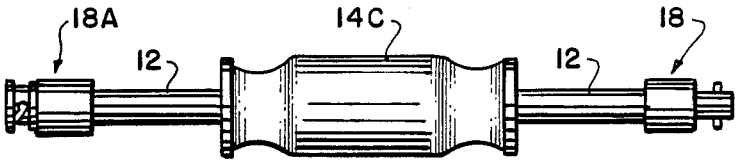
FIG. 10

DEVICE FOR MOUNTING ELECTRONIC CONNECTORS

BACKGROUND OF THE INVENTION

This invention generally relates to tools, and more specifically, to a device for mounting electronic connectors, such as BNC connectors, on a wall of a housing or chassis.

There are a number of radio frequency (RF) connectors commonly used to connect coaxial cables to RF input or output ports on electronic equipment. One example of a commonly used RF connector is called a BNC connector (UG 1094/U, UG 625/U, KC 79-58, 31-10, etc.). Other examples of RF connectors are type N, type E and the like. There are a few dozen types of such connectors—all of which serve essentially the same function—to provide a good connection in an RF line. This requires maximum RF shielding and impedance matching so that there is maximum power transfer down the line. Any damage or deformation of RF connectors may introduce changes in connector impedance and may result in RF leakage and interference with other proximate electronic circuits.

The most common connectors mounted on electrical housings or chassis are the female type electrical connectors (UG 1094/U, KC 79-48, 31-10, etc.) which are stud mounted with bayonet-type couplings. Types KC 79-58 are male versions in the BNC type. Both types, however, include either a male or female mating portion used to make the mechanical and electrical connection to a mating connector and a threaded stud which is received within an opening in the wall of a housing or chassis and mechanically secured to the wall with a threaded nut. Typically, the nut is tightened with a wrench while the connector is manually held against rotation. However, because the threaded stud is most frequently positioned inside the housing or chassis, which may contain numerous electrical components, the insertion of the wrench into the housing, securement of the nut and tightening thereof may be awkward or even difficult due to a space factor and may sometimes result in damage to the internal components. Also, any attempt to grip the electrical mating portion with a tool, such as a pair of pliers, to secure same against rotation while the nut is being tightened, may deform or otherwise damage the electrical mating portion.

SUMMARY OF THE INVENTION

Accordingly, it is an object of the invention to provide a tool for mounting electronic connectors.

It is another object of the invention to provide a tool as aforementioned which facilitates easy and speedy installation of electronic RF connectors.

It is still another object of the invention to provide a tool as suggested in the aforementioned objects which does not introduce damage or deformation to these connectors to be mounted or damage to the components within a mounting housing or chassis.

It is yet another object of the invention to provide a tool for mounting electronic connectors on a wall of a housing or chassis by rotating the electrical mating portion of the connector in the front of the panel or wall of the housing or chassis, which is free and clear of all internal components, while securing the nut against rotation.

In order to achieve the above objects, as well as others which will become evident to those skilled in the art, there is provided a device for mounting one of a pair of mating connectors on one side of a mounting wall, the connectors to be mounted having a mating portion engageable by the other of the pair of mating electronic connectors and positionable on said one side of said mounting wall, and having a mounting portion positionable on the other side of the mounting wall for mounting on the mounting wall upon application of a torque on said mating portion relative to said mounting portion. The device comprises shaft means and handle means provided on said shaft means for facilitating manual gripping thereof. Driver means is provided at one end of said shaft means, said driver means being shaped to correspond to the other of the pair of mating connectors to permit mating engagement between said driver means and the connectors to be mounted. In this manner, engagement between said driver means and the connector to be mounted permits application of the necessary torques thereon and facilitates the mounting of the electronic connector on the mounting wall without deformation or damage thereto.

BRIEF DESCRIPTION OF THE DRAWINGS

Other objects and advantages of the invention will become apparent from a consideration of the details of the specification and the accompanying drawings, wherein:

FIG. 5 is an enlarged cross-sectional view of the tool shown in FIG. 1, taken along line 5—5, also showing the wall or panel of a housing or chassis on which a male BNC connector is to be mounted;

FIG. 6 is an enlarged cross-sectional view of the tool shown in FIG. 2, taken along line 6—6, showing the wall or panel of a housing or chassis on which a female BNC connector is to be mounted;

FIG. 7 illustrates another embodiment of the tool in accordance with the present invention wherein male and female BNC drivers are provided at opposite ends of a shaft, each end being interchangeably receivable within a socket opening of a handle to permit selective use of either BNC driver to mount a mating BNC connector;

FIG. 8 illustrates still another embodiment of the invention, wherein a male BNC driver is mounted on a shaft connected to a cross member to provide a T-shaped handle for leveraged manual gripping;

FIG. 9 is similar to FIG. 8, wherein the male BNC driver is replaced with a female BNC driver; and FIG. 10 is similar to FIG. 7, wherein a handle is permanently secured to the central portion of the tool shaft.

DESCRIPTION OF THE PREFERRED EMBODIMENTS

Figure 1:
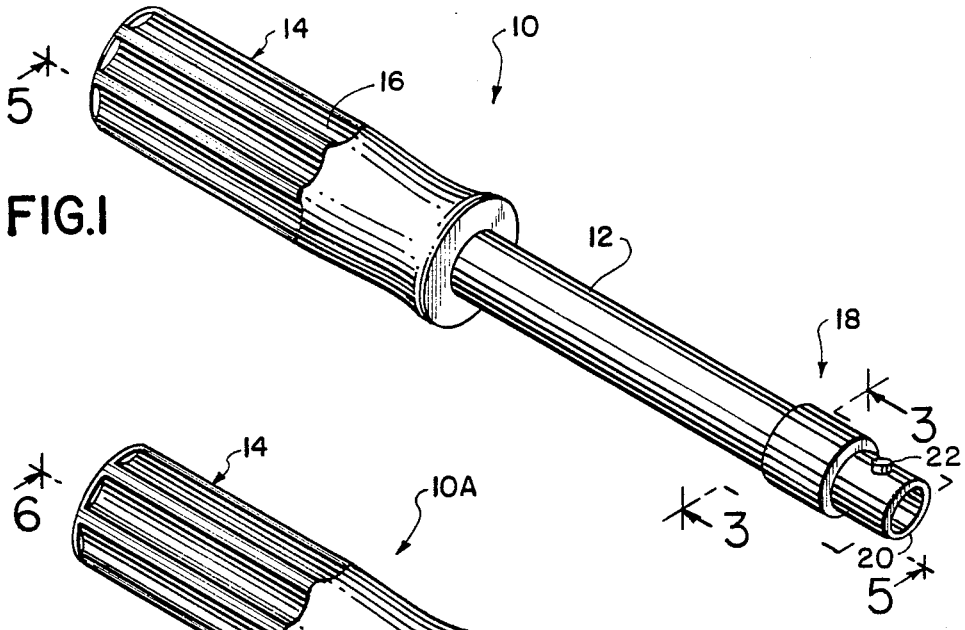
FIG. 1 is a perspective view of a tool in accordance with the present invention with a female BNC driver for mounting a male BNC electronic connector.
Figure 3:
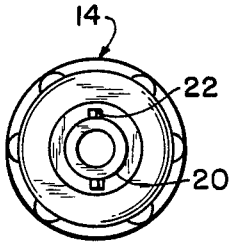
FIG. 3 is an enlarged cross-sectional view of the tool shown in FIG. 1, taken along line 3—3.

Referring now specifically to the Figures, wherein the identical or similar parts have been designated by the same reference numerals throughout, and first referring FIGS. 1 and 3, a first embodiment of the tool in accordance with the present invention is generally designated by the reference numeral 10.

The device or tool 10 includes a shaft 12. A handle 14 is permanently secured to one end of the shaft 12 and is advantageously provided with a surface which facilitates manual gripping thereof, such as the provision of axial surface ribs 16 as shown. An important feature of the invention is the provision of a BNC driver element 18 at the other end of the shaft 12.

The driver element 18 includes a sleeve 20 which supports diametrically opposite pins 22 and is otherwise shaped and dimensioned to correspond to a female BNC RF connector-type so that it can mate with and engage a male BNC RF connector-type as though the driver 18 were itself a female BNC connector.

Referring to FIG. 5, there is shown the manner in which a male BNC connector 24 is to be mounted on a wall or panel 26 of a housing or chassis 28. The BNC male connector 24 is shown to have a mating portion 24*a* intended to engage a BNC female connector (not shown). The mating portion 24*a* is positioned on the outside surface of the mounting wall 26 or the exterior of the chassis 28 and is provided with a sleeve 24*b* provided with a groove 24*c*, including longitudinal and peripheral groove portions, respectively, dimensioned to receive the sleeve 20 and the pins 22. The BNC connector 24 is also provided with a mounting portion or stud 24*d* for mounting the connector on the wall or panel 26. As with many RF or electronic connectors, the mounting stud 24*d* is threaded for cooperation with a threaded nut 30 which must be rotated on the threaded stud until the panel or wall 26 is tightly secured between the mounting portion 24*a* and the nut 30. As suggested, this has normally entailed manually gripping the mating portion 24*a* and a pliers or other tool is inserted into the chassis or housing and the nut 30 is rotated while an attempt is made to secure or fix the remaining portion 24*a*. As will be appreciated from FIG. 5, the use of the tool or device 10 permits the locking engagement of the BNC driver 18 and the mating portion 24*a* to rotate the latter while the nut 30 is held fixed such as by manual gripping thereof or engagement with a wrench or pliers.

In order to provide leveraged gripping to facilitate application of sufficiently high torque to tighten the nut 30, the handle 14 is advantageously enlarged as shown in FIGS. 1, 2, 5–7 and 10 or provided with a cross-member 32 such as shown in FIGS. 8 and 9 to provide a T-shaped handle.

Figure 2:
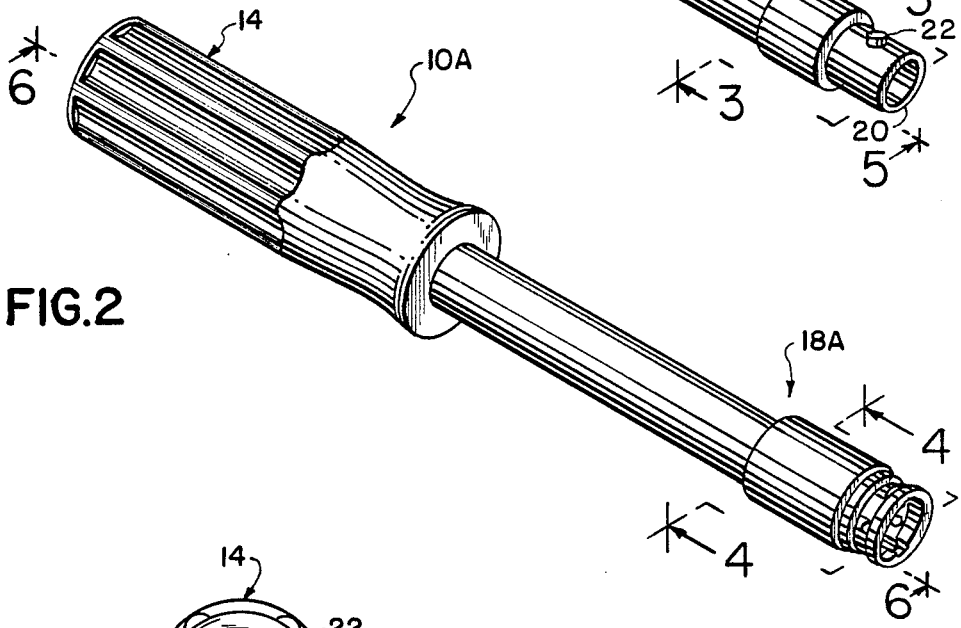
FIG. 2 is similar to FIG. 1 but showing a tool with a male BNC driver for mounting a female BNC connector.
Figure 4:
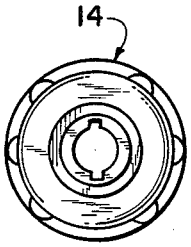
FIG. 4 is an enlarged cross-sectional view of the tool shown in FIG. 2, taken along line 4—4.

Referring to FIGS. 2 and 4, another embodiment of the tool or device is shown and designated by the reference numeral 10A. The tool 10A is similar to the one shown in FIGS. 1 and 3, with the exception that the tool is provided with a male BNC driver for mounting a female BNC connector. The tool 10A is used to mount female connectors as suggested in FIG. 6. With the exception of the reversal of the electronic connector type, the previous discussion with regard to the tool or device 10 is equally applicable to the tool 10A.

Referring to FIG. 7, the shaft 12 is provided at opposite ends with female and male drivers 18, 18*a*. In order to allow selective use of either driver, there is additionally provided at each end of the shaft 12 enlarged portions 32 receivable within a socket opening 14B of a handle 14A. Thus, in order to use the male driver 18A to mount a female connector, the female driver 18 and the enlarged portion 32 at the same end are inserted into the socket opening 14B.

In FIG. 10, a still further embodiment is illustrated which is similar to the one shown in FIG. 7 in that both female and male drivers 18, 18*a* are provided at opposite ends of the shaft 12. However, instead of providing a handle with a socket opening, a handle 14C is permanently and rigidly secured to the central region of the shaft 12.

It will be understood that the devices or tools described are merely illustrative of the principle of this invention and that other embodiments may be devised without departing from the scope of the invention. Thus, while the embodiments have been described as including BNC drivers, other electrical or RF connector types can be used. In each case, however, the driver is shaped to correspond to the shape of a mating electronic or RF connector. By the use of this tool, or device, the connectors are tightened in front of the panel or chassis which is free and clear of all internal components. This allows for a quick and easy installation of these connectors without damage or deformation thereto and, above all, provides a time saving means of installation, especially when used in manufacturing or production.

What is claimed is:

1. Device for mounting one of a pair of mating electronic connectors on one side of a mounting wall, the connector to be mounted having a mating portion engageable by the other of the pair of mating connectors and positionable on said one side of said mounting wall, and having a mounting portion positionable on the other side of said mounting wall for mounting on said mounting wall upon application of a torque on said mating portion relative to said mounting portion, said device comprising shaft means; handle means provided on said shaft means for facilitating manual gripping thereof; and driver means provided at one end of said shaft means, said driver means having a configuration of a male BNC connector to permit engagement with and mounting of a female BNC connector, and whereby engagement between said driver means and the female BNC connector to be mounted permits application of the necessary torque thereon and facilitates the mounting of the female BNC connector on the mounting wall without deformation or damage thereto.

2. Device as defined in claim 1, wherein said handle means comprises a cross-member to form a T-shaped handle.

3. Device for mounting one of a pair of mating electronic connectors on one side of a mounting wall, the connector to be mounted having a mating portion engageable by the other of the pair of mating connectors and positionable on said one side of said mounting wall, and having a mounting portion positionable on the other side of said mounting wall for mounting on said mounting wall upon application of a torque on said mating portion relative to said mounting portion, said device comprising shaft means; handle means provided on said shaft means for facilitating manual gripping thereof; driver means provided at one end of said shaft means, said driver means being shaped to correspond to the other of the pair of mating connectors to permit mating engagement between said driver means and the electronic connector to be mounted, whereby engagement between said driver means and the electronic connector to be mounted permits application of the necessary torque thereon and facilitates the mounting of the connector on the mounting wall without deformation or damage thereto, and further comprising additional driver means at the other end of said shaft means, said additional driver means being shaped to correspond to said one of the pair of mating connectors, whereby the device is capable of mounting either one of a pair of electronic connectors by engagement with the correspondingly shaped mating driver means.

4. Device as defined in claim 3, wherein said handle means comprises an elongate handle having a longitudinal axis coextensive with the axis of said shaft means and mounted on one end of said shaft means.

5. Device as defined in claim 4, wherein said handle is provided with axial surface ribs to facilitate gripping of same.

6. Device as defined in claim 3, wherein the electronic connectors are BNC connectors.

7. Device as defined in claim 3, wherein said driver means has a configuration of a female BNC connector to permit engagement with and mounting of male BNC connectors.

8. Device as defined in claim 3, wherein said handle means is mounted in the central region of said shaft means.

9. Device as defined in claim 3, wherein said handle means comprises a handle having a socket opening, said shaft means being provided with a socket portion at each end thereof receivable within said socket opening, whereby either end of said shaft means may be inserted into said handle to thereby permit use of a desired driver means at the other end of said shaft means.

* * * * *